United States Patent [19]

Lennartson

[11] 4,240,563

[45] Dec. 23, 1980

[54] AUXILIARY DISPENSING UNIT FOR SPIRAL VENDOR

[75] Inventor: Douglas G. Lennartson, Coon Rapids, Minn.

[73] Assignee: Gross-Given Manufacturing Company, Saint Paul, Minn.

[21] Appl. No.: 955,313

[22] Filed: Oct. 27, 1978

[51] Int. Cl.[3] ..... G07F 11/36

[52] U.S. Cl. ..... 221/75; 221/242

[58] Field of Search ..... 221/75, 242; 198/475

[56] References Cited

U.S. PATENT DOCUMENTS

| | | | |
|---|---|---|---|
| 3,269,595 | 8/1966 | Krakauer et al. | 221/75 |
| 3,840,147 | 10/1974 | O'Neal et al. | 221/75 |
| 3,908,858 | 9/1975 | Wirstlin et al. | 221/75 |
| 3,929,255 | 12/1975 | Wittern et al. | 221/75 |
| 3,935,966 | 2/1976 | Pitel et al. | 221/75 |
| 3,952,915 | 4/1976 | Pitel et al. | 221/75 |
| 4,061,245 | 12/1977 | Lotspeich | 221/75 |

*Primary Examiner*—F. J. Bartuska

*Attorney, Agent, or Firm*—Merchant, Gould, Smith, Edell, Welter & Schmidt

[57] ABSTRACT

A helical coil vending machine includes a housing having a plurality of shelves thereon. Each shelf includes a plurality of elongated helical coils of a first size received in dispensing channels having a nominal width. This invention relates to an auxiliary dispensing unit which can be received in selected ones of the dispensing channels. The auxiliary dispensing unit includes a replacable insert member or trough receivable in the dispensing channel to decrease its cross-sectional width. The first sized coil in this channel is then replaced by a second and smaller coil which is received inside the insert member. The auxiliary dispensing unit is suited for receiving relatively thin articles such as gum and mint packages therebetween for vending such articles using a helical coil mechanism.

2 Claims, 3 Drawing Figures

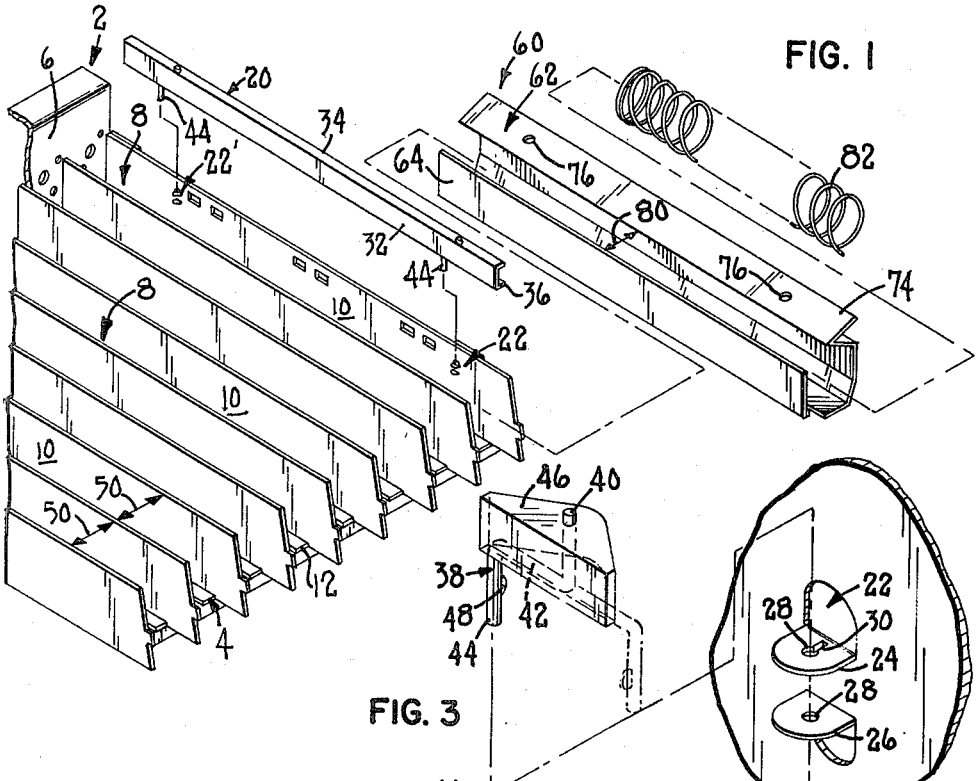
FIG. 1
FIG. 3
FIG.2
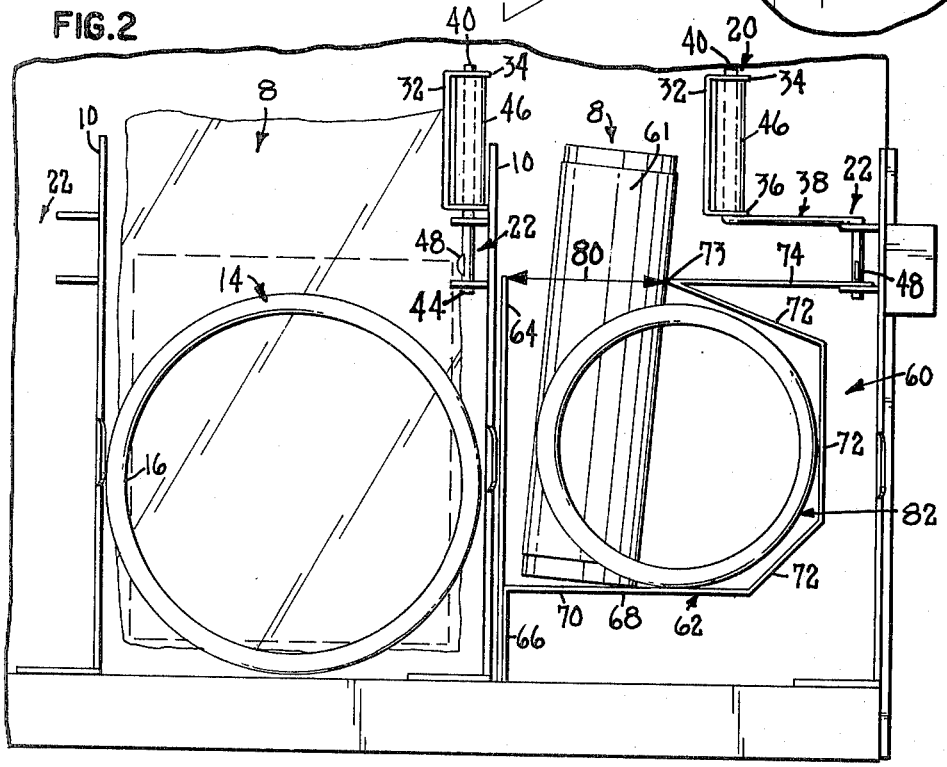

AUXILIARY DISPENSING UNIT FOR SPIRAL VENDOR

BACKGROUND OF THE INVENTION

1. Field of the Invention

This invention relates in general to automatic vending machines for dispensing food products and similar articles. More particularly, this invention relates to a vending machine of the helical coil type having means for dispensing relatively thin and small products, e.g. gum and mint packages.

2. Description of the Prior Art

Various vending machines are known which may be generically referred to as helical coil vending machines or, alternatively, as spiral vendors. Such machines usually comprise a housing in which a plurality of shelves are slidably mounted. Each shelf usually includes a plurality of elongated helical coils which run from one side of the shelf to the other (e.g. from front to back). A plurality of food products to be dispensed are received between the adjacent convolutions of the coils and are dispensed over the front edge of the shelf as the coil is rotated. The coils are often received between side members or walls such that each coil lies in a product receiving trough or channel.

Most helical coil vending machines are adapted to dispense food products of certain sizes. These food products include bags of potato chips, pastry products, and other types of so-called "snack products". It has been the practice in the art to use different sized helical coils and adjustable product guide members in the same vending machine to accomodate variations in the size of the food products being dispensed. Even with such a feature, the coils and channels in most helical coil vending machines are not suitable for dispensing very small food products, such as gum and rolled mint products. These types of food products have conventionally been dispensed by an entirely separate dispenser which is included as part of the vending machine. However, this is disadvantageous if the cost of the vending machine is an important consideration since it is relatively expensive to provide a totally separate dispenser for gum and mint products.

Vending machine manufacturers have attempted to solve the above-identified problem by devising ways in which gum and mint products can be vended using helical coils. This has generally been accomplished by using an elongated divider member between the convolutions of the coil to decrease the width of the product receiving channel. In effect, this forms two small product receiving channels at either side of the coil in which gum and mint products can be effectively received. This approach of using an axial divider is disclosed in U.S. Pat. No. 3,929,255 to Wittern et al and U.S. Pat. No. 3,935,966 to Pitel et al.

Although the above-mentioned devices allow gum and mint products to be dispensed using helical coils, the use of an axial separator or divider member through the convolutions of the coil presents certain problems. For one thing, it can be difficult to secure the axial separator inside the coil convolutions. In addition, if the coil sags or otherwise contacts the separator there is always the possibility that the separator could jam or interfere with the rotation of the coil. Furthermore, since the axial separator divides the coil into two product receiving channels for each convolution, to vend only one product at a time it is necessary that the coil be rotated through only one half of a revolution. This requires that there be some means for controlling the operation of the coil rotating motor such that the coil can be rotated a full revolution when vending normal sized products or half a revolution when vending gum and mint products. Thus, the axial separator system cannot be used in many machines where the coil rotating motors are designed to rotate only through one revolution during each operation of the motor.

SUMMARY OF THE INVENTION

One aspect of this invention is a helical coil vending machine having an auxiliary dispensing unit incorporating a helical coil for dispensing relatively thin food products, e.g. gum and mint products.

The present invention comprises a vending machine having a housing. The housing contains a plurality of vertically spaced shelves each of which contain at least one elongated helical dispensing coil thereon. The coil has a plurality of convolutions for receiving the food products to be vended. In addition, the coil is bounded by side walls which define a product receiving channel. The present invention relates to an auxiliary dispensing unit which is receivable in the channel. The unit includes a trough which may be selectively located and locked in the product receiving channel to decrease the cross-sectional width thereof. The normal sized helical coil is replaced by a second auxiliary helical coil having a diameter smaller than that of the normal sized coil and received inside the trough. The trough defines an auxiliary receiving channel in which gum and mint products can be held therein in a substantially upright position between the convolutions of the coil. The gum and mint products are then dispensed over the edge of the shelf upon rotation of the auxiliary coil.

BRIEF DESCRIPTION OF THE DRAWINGS

The present invention will be described hereafter in the Detailed Description, when taken in conjunction with the following drawings, in which like reference numerals refer to like elements throughout.

FIG. 1 is a perspective view of one shelf of a helical coil vending machine according to the present invention, particularly illustrating the auxiliary dispensing unit for use inside the product receiving channel with the parts thereof being shown in an unassembled exploded form;

FIG. 2 is a front view of a portion of the shelf shown in FIG. 1, particularly illustrating one normal sized coil received in a product receiving channel for vending food products and the auxiliary dispensing unit of this invention being illustrated in the adjacent product receiving channel for dispensing gum and mint food products; and FIG. 3 discloses a portion of the product guide member illustrated in FIG. 1 and its method of attachment to the side walls of the product receiving channel.

DETAILED DESCRIPTION

This invention relates to an improved helical coil vending machine of the general type shown in U.S. Pat. No. 4,061,245, issued to Joseph A. Lotspeich on Dec. 6, 1977, and assigned to the assignee of the present application. The above-mentioned patent is incorporated by reference with regard to the details of the vending machine. However, the vending machine will be described herein insofar as is pertinent to a background for and an understanding of this application's invention.

Referring to FIG. 1, one shelf of the vending machine is generally indicated as 2. The vending machine has a substantially rectangular housing closed by an openable front door. A plurality of shelves identical to the shelf 2 are vertically located in a spaced apart orientation in the housing. The construction of each shelf is generally similar so that a description of one shelf 2 will suffice to describe the others.

Shelf 2 includes a substantially horizontal base or support surface 4 having an upwardly extending rear wall 6. Shelf 2 is divided into a plurality of product receiving tracks or channels 8 by a plurality of longitudinal vertical members or walls 10. Walls 10 run the entire length of the shelf 2 from the rear wall 6 to the front edge 12 thereof. Walls 10 are laterally spaced apart a sufficient distance to define channel 8 in which a first normal sized elongated helical coil 14 is received. Each helical coil 14 has a plurality of convolutions and a generally circular cross-section. Each coil 14 terminates near the front end 12 of shelf 2 in a discharge end 16 and at the rear end of the shelf adjacent rear wall 6 in a driven end. The discharge ends 16 of all the coils in the vending machine are appropriately spaced from the front door of the vending machine to provide a discharge space into which food products can be vended.

A separate motor (not shown) is provided for rotating each of the helical coils 14 in a direction to allow dispensing of the food products received between the convolutions thereof. Each of these motors is secured (e.g., by screws or the like) to the rear side of rear wall 6. Each motor has a shank which extends through the rear wall and into the rear of each product receiving channel 8. The driven ends of each of the helical coils 14 have any suitable means for releasably attaching to the shank of the motor. One particular form of releasable connection may be that shown in the above-mentioned U.S. patent, i.e. a U-shaped cross bracket having two opposed semi-circular slots. These slots detachably receive a plurality of retaining clips on a cross-bracket holding member which is fixedly coupled to the motor shank.

Each product receiving channel 8 has an elongated product guide member 20 attached to one of the side walls 10 thereof. As shown in FIGS. 1 and 3, one side wall 10 of each product receiving channel 8 has two sets 22 or 22' of inwardly extending flanges or brackets. Each set of flanges comprises an upper flange 24 which is vertically spaced from a generally similarly shaped lower flange 26. The upper and lower flanges have aligned apertures 28 therein. In addition, the aperture 28 on the upper flange 24 has a rearwardly extending key slot 30 or the like therein. As shown in FIG. 3, each of the flanges 24 and 26 may be merely stamped out of the material of which the side walls 10 are made. However, these flanges could if so desired comprise an additional piece welded or otherwise secured to the side wall.

The product guide member 20 includes an elongated U-shaped channel having a vertical portion 32 and two horizontal lip portions 34 and 36. The product guide member 20 is pivotably mounted in each of the product receiving channels 8 by virtue of two spaced crank arms 38. Each crank arm 38 includes a first vertically extending portion 40, a second horizontally extending portion 42, and a third vertically extending portion 44. As shown in FIG. 3, the first vertically extending portion 40 of each crank arm is inserted through vertically aligned apertures in plastic sleeve support members 46. The plastic sleeve members 46 are positioned between the top and bottom horizontal lip portions 34 and 36 of guide member 20 at the pivot points therefor. The upper vertical portions 40 of the crank arms 38 frictionally engage the inner surfaces of the plastic sleeve members 46 adjacent the apertures. This allows the product guide member 20 to be pivotably rotated to any desired lateral spacing from the side wall 10 by rotating the product guide member 20 about its pivot points (e.g., the crank arm 38) to its desired location. Once the desired location has been obtained, the frictional fit between the crank arms 38 and the sleeve members 46 will maintain the lateral positioning of the product guide member 20 until being readjusted by an operator of the machine.

Each of the product guide members 20 is releasably held in the bracket sets 22 and 22' by virtue of the crank arms 38. In this regard, the lower vertical portion 44 of each crank arm 38 has an outwardly extending lug or barb 48 thereon. When it is desired to install the product guide member 20 on the bracket sets 22 and 22', each crank arm 38 has the lower vertical portion 44 located rearwardly of the upper vertical portion 40 and is rotated generally colinear with regard to the product guide member 20 as shown in FIG. 2. In such a position, the barb 48 can be aligned with the slot 30 in the upper flange as the lower vertical portion 44 of each crank arm 38 is inserted into the corresponding aperture 28. Once the lower vertical portion 44 of the crank arm passes through the crank arms 24, a lower end of the vertical portion 44 is then received in the aperture 28 in the lower flange 26 with the barb 48 then being located above flange 26. Then, the product guide member 20 is rotated 180° about the crank arm such that the product guide member has been moved rearwardly along the wall 10 of the channel with the lower vertical portion 44 now being located in front of the upper vertical portion 40. See the solid line and phantom line positions of the crank arm 38 in FIG. 3 which correspond to the location of the crank arms 38 before and after rotation of the product guide member. In this position, the product guide member 20 is held against the wall 10 but is prevented from being removed from the brackets by virtue of the barb 48 which has been angularly offset 180° from the slot 30. Then, the product guide member 20 can be moved away from the wall 10 to adjust to the thickness or width of the product contained in the vending channel. The maximum offset of the product guide member 20 from the wall 10 corresponds to a position where the crank arms 38 have been rotated approximately 90°.

As shown in FIGS. 1 and 2, each of the product receiving channels 8 has a normal nominal width 50 to receive therein the helical coils 14 of a first predetermined diameter. Coils 14 are suitable for vending most of the food products for which the vending machine is meant for use. In addition, when relatively long and skinny articles are being vended, the product guide members 20 can be located at a position offset from the side wall 10 to accommodate the decrease in the width of the articles being vended. Notwithstanding this feature, it has been impossible in the past to vend very thin products, such as gum, mint and other rolled candy packages. First, the normal sized coils 14 are too big to adequately support the gum and mint products (e.g., these products fall over in the convolutions of the coil). Secondly, these very thin products may not be tall enough to be contacted by the product guide members and the guide members can not be offset far enough from the wall 10 to contact the products.

The present invention comprises a selectively usable auxiliary dispensing unit which can be demountably installed in any of the product receiving channels 8 for dispensing gum and mint products or similarly shaped ultra thin articles shown at 61. The auxiliary dispensing unit, generally indicated as 60, includes a replaceable insert member or trough which is generally indicated as 62 in FIGS. 1 and 2. Insert member 62 is made in two parts and comprises a first longitudinally extending vertical wall 64. Vertical wall 64 is fixedly connected, as by welding, to the vertical wall portion 66 of the second part 68 of the insert 62. The second part 68 of the insert 62 includes a substantially horizontal base member 70 and side members 72 which extend upwardly from the base member 70 in a reversed C-shape. The top side member 72 has an upper flange 74 which extends away therefrom in a substantially horizontal direction. This flange 74 has two spaced apertures 76 located therein with the same spacing as the crank arms 38 of the product guide members 20 (i.e., same spacing as 22 and 22').

The replaceable insert 62 can be detachably coupled in any selected product receiving channel 8. First, the normal sized helical coil 14 is removed from the selected channel 8 and the product guide member 20 for that channel is detached from the brackets 24 and 26. The insert 62 is then aligned with the front end of the channel 8 with the vertical wall 64 being positioned adjacent one side wall 10 and the flange 74 having its outer edge received on top of the lower flange 26 on the opposite side wall 10. Insert 62 is then slid inwardly in channel 8 until it substantially covers the entire longitudinal length of the channel 8 with the apertures 76 in flange 74 being aligned with the apertures 28 in the flanges 24 and 26. The product guide member 20 can then be reinstalled through the apertures 28. In this regard, the vertical portion 44 of each crank arm 38 will pass through one of the apertures 76 in flange 74. This prevents insert 62 from moving longitudinally in the product receiving channel 8. Thus, the product guide member 20 effectively serves as the means for locking or retaining the insert 62 in place in the product receiving channel 8. In addition, use of insert 62 serves as an effective means for reducing the cross sectional width of the product receiving channel 8 from its normal width 50 to the width 80 occurring between the wall 64 and the inner edge 73 of the flange 74.

Once the insert 62 has been installed in the manner noted above, a second helical coil 82, which forms a second part of the auxiliary dispensing unit 60, is placed inside insert 62 as shown in FIG. 2. The second helical coil 82 has a diameter which is smaller than the diameter of the normal sized coil 14. However, second coil 82 has a cross bracket at the driven end thereof for being releasably mounted on the shank of the coil rotating motor in the same manner as the normal sized coil 14. With the second coil 82 installed inside the trough defined by insert 62, gum and mint or similar products can then be placed in a line between the convolutions of the coil 82. These gum or mint products will be maintained as shown in FIG. 2 in a slightly tilted orientation between the horizontal wall 70 of insert 62 and the inner edge 73 of the flange 74. The gum and mint products will be securely held in the auxiliary dispensing unit 60 without any possibility of these products falling over between the convolutions of the coil 82.

Whenever it is desired to vend the gum or mint products 61, the second helical coil 82 is rotated through one full revolution to dispense the product held in the foremost convolution of the coil. By virtue of the replaceable insert 62 and the smaller coil 82, no adjustment need be made in the coil rotating motor to allow the motor to rotate only half a revolution. Instead, the vending of gum and mint products 61 will occur in a normal manner with a full revolution of the coil 82. Thus, the auxiliary dispensing unit 60 of this invention can be used with helical coil vending machines even where the coil rotating motors of the machine have no procedure for varying the rotation thereof.

Current trends in the vending machine industry point to the utilization of smaller and less expensive vending machines. In such machines, it is too expensive to have a separate gum and mint dispenser. However, such a vending machine will still have a plurality of shelves each of which contains a plurality of helical coil dispensing units. Thus, with such a machine, whenever it is desired to dispense gum and mint products, the machine operator can simply convert several of the normal product receiving channels 8 to gum and mint dispensing channels by simply installing the auxiliary dispensing units 60 therein. It is contemplated that each of the normal product receiving channels 8 in the vending machine will be provided with a product guide member 20. Thus, any one of these product receiving channels 8 can be converted to a gum and mint dispensing channel as noted above. This allows the machine operator to have a great deal of flexibility by converting only so many channels 8 as needed for dispensing gum and mint products while retaining the remainder of the channel for use in dispensing normal sized food products. Thus, a vending machine according to this invention can vend both normal sized products and very thin food products, such as gum and mint packages, without needing to have a separate gum and mint dispenser.

Various modifications of this invention will be apparent to those skilled in the art. Obviously, the configuration of the insert 62 can vary widely as long as it functions to decrease the cross-sectional width of the product receiving channel 8 and serve as a means for enclosing the smaller coil 82. Thus, the scope of this invention is to be limited only by the appended claims.

What is claimed is:

1. An improved vending machine of the type having a housing; a plurality of vertically spaced shelves contained in the housing, each of the shelves having a plurality of dispensing coils of a first pre-determined size mounted thereon; and wherein each of the first sized dispensing coils is located in a dispensing channel having a first pre-determined width; motor means releasably connected to the dispensing coils for rotating the coils in a dispensing direction; and wherein the improvement relates to at least one auxiliary dispensing unit which can be selectively used in any of the dispensing channels, wherein the auxiliary dispensing unit comprises:

(a) a replaceable insert member which is receivable inside the dispensing channel to decrease the cross-sectional width of the dispensing channel from its first width to a second and smaller width, in which the replaceable insert member includes means for holding relatively thin products in a substantially upright tilted position, and in which the product holding means includes an upper support flange horizontally offset a small distance from a side wall of the insert member such that an upper end of each product is slidably retained between the side wall and the support flange; and (b) a second helical dispensing coil having a smaller size than the first coil and serving to replace the first coil in the dispensing channel, the second dispensing coil being operatively connected to the motor means, whereby the auxiliary dispensing unit is suitable for dispensing the relatively thin products contained in the insert member between the convolutions of the second helical coil.

2. An improved vending machine of the type having a housing; a plurality of vertically spaced shelves contained in the housing, each of the shelves having a plurality of dispensing coils of a first pre-determined size mounted thereon; and wherein each of the first sized dispensing coils is located in a dispensing channel having a first pre-determined width; motor means releasably connected to the dispensing coils for rotating the coils in a dispensing direction; and wherein the improvement relates to at least one auxiliary dispensing unit which can be selectively used in any of the dispensing channels, wherein the auxiliary dispensing unit comprises:

(a) a replaceable insert member which is receivable inside the dispensing channel to decrease the cross-sectional width of the dispensing channel from its first width to a second and smaller width;

(b) a second helical dispensing coil having a smaller size than the first coil and serving to replace the first coil in the dispensing channel, the second dispensing coil being operatively connected to the motor means, whereby the auxiliary dispensing unit is suitable for dispensing relatively thin products contained in the insert member between the convolutions of the second helical coil; and (c) means for retaining the insert member in the dispensing channel, in which the retaining means comprises a detachable product guide member, wherein one guide member is located in each of the dispensing channels, each product guide member having two downwardly extending crank arms pivotably received in the dispensing channel, and wherein the insert member has apertures through which the crank arms extend such that the crank arms lock the insert member in the channel.

* * * * *